US006904626B1

(12) United States Patent
Hester et al.

(10) Patent No.: US 6,904,626 B1
(45) Date of Patent: Jun. 14, 2005

(54) FLUIDIC SPA NOZZLE

(75) Inventors: Russell Hester, Odenton, MD (US); Steven Crockett, Hempstead, MD (US); Jerry Wayne Thurber, Jr., Woodbine, MD (US); Keith Schloer, Owings Mills, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 0 days.

(21) Appl. No.: 10/290,444

(22) Filed: Nov. 8, 2002

Related U.S. Application Data

(60) Provisional application No. 60/331,131, filed on Nov. 9, 2001.

(51) Int. Cl.[7] ..... A61H 33/02

(52) U.S. Cl. ..... 4/541.6; 239/428.5; 239/589.1; 239/599

(58) Field of Search ..... 4/541.6; 239/418, 239/428.5, 433, 589.1, 596, 597, 599

(56) References Cited

U.S. PATENT DOCUMENTS

| | | | | | |
|---|---|---|---|---|---|
| 3,471,091 | A | | 10/1969 | Baker | 239/416 |
| 3,563,462 | A | * | 2/1971 | Bauer | 239/589.1 X |
| 4,151,955 | A | * | 5/1979 | Stouffer | 239/589.1 X |
| 4,227,550 | A | | 10/1980 | Bauer et al. | 137/835 |
| 4,325,235 | A | | 4/1982 | Bauer et al. | 68/3 SS |
| 4,407,032 | A | | 10/1983 | Bauer et al. | 8/158 |
| 4,416,030 | A | | 11/1983 | Reynoso | 4/496 |
| 4,800,046 | A | | 1/1989 | Malek et al. | 261/50.3 |
| 4,982,459 | A | | 1/1991 | Henkin et al. | 4/541.4 |
| 4,985,943 | A | | 1/1991 | Tobias et al. | 4/541.6 |
| 5,095,558 | A | | 3/1992 | Howard | 4/541.6 |
| 5,269,029 | A | | 12/1993 | Spears et al. | 4/541.6 |
| 5,495,627 | A | | 3/1996 | Leaverton et al. | 4/541.6 |
| 5,810,257 | A | | 9/1998 | Ton | 239/259 |
| 6,378,146 | B1 | | 4/2002 | Johnston | 4/541.1 |
| 6,401,273 | B1 | | 6/2002 | Fung et al. | 4/559 |
| 6,575,386 | B1 | * | 6/2003 | Thurber et al. | 239/418 |

* cited by examiner

*Primary Examiner*—Robert M. Fetsuga
(74) *Attorney, Agent, or Firm*—Jim Zegeer

(57) ABSTRACT

There is disclosed a fluidic spa tub nozzle having a fluidic oscillator with diverging sidewalls and a cooperating mode-change member for changing the mode from an oscillatory swept jet mode to a straight jet mode and positions there-inbetween. The fluidic oscillator has an inertance loop formed by groove plates secured to the top and bottom walls of the fluidic oscillator.

12 Claims, 5 Drawing Sheets

FLUIDIC SPA NOZZLE

REFERENCE TO RELATED APPLICATIONS

This application is related to provisional application Ser. No. 60/331,131 filed Nov. 9, 2001 entitled FLUIDIC SPA NOZZLE WITH MODE CHANGE DISC.

BACKGROUND AND BRIEF DESCRIPTION OF THE INVENTION

Fluidic and spa nozzles are widely known in the art. See for example the following patents:

| U.S. Pat. Nos. | Inventor |
|---|---|
| 3,471,091 | Baker |
| 4,151,955 | Stouffer |
| 4,227,550 | Bauer |
| 4,325,235 | Bauer et al |
| 4,407,032 | Bauer et al |
| 4,416,030 | Reynoso |
| 4,800,046 | Malek et al |
| 4,982,459 | Henkin |
| 4,985,943 | Tobias et al |
| 5,095,558 | Howard |
| 5,269,029 | Spears et al |
| 5,495,627 | Leaverton |
| 5,810,257 | Ton |
| 6,378,146 | Johnston |
| 6,401,273 | Fung et al |

The present invention incorporates fluidic oscillators adaptable for submerged operation, e.g. for spa use, which can be caused to sweep or not sweep a jet of water with simple manual adjustment from the front of the device. In addition, the frequency of oscillation or sweeping of the water jet into the spa can be changed by adjusting the length and size of the inertance loop plates attached to the walls of the fluidic element itself. The inertance plates have inertance loop-forming grooves formed therein, one end of each inertance plate, forming a loop groove being juxtaposed over an aperture to a control passage and the other end of the loop groove being juxtaposed over a pass-through port or passage to the corresponding end of the loop on the loop groove in the opposing inertance plate to thereby form the frequency determining loop connecting the control ports of the fluidic oscillator.

The invention also features a mode disc which is secured to the front of the fluidic in such a manner as to allow it to be manually rotated by a spa user to change the outlet geometry of the fluidic element and thus the character of the fluidic stream. In one position, the mode ring has a slot which aligns with and provides a continuation of the fluidic exit geometry and thus allows the water jet to oscillate. Upon rotation of 90°, for example, the slot is perpendicular to the fluidic exit geometry, and this results in the edges of the oscillating wave being backloaded so that the output is a straight focused jet. The shape of the rectangle can be made with the generally round section to control the feel of the jet in the jet mode. In addition, it can be adjusted to angles in between to achieve progressively narrower oscillations. The mode control disc has a pair of depressions or slots to each side of the slot in the mode disc to enable easy and firm grasping between the user's fingers.

Air is routed through a central control valve. Air enters the rear of the spa nozzle housing and is kept separated from the water passages by O-rings. The air passes through two channels along either side of a water conditioning passage.

The air goes to the top and bottom inertance plates of the fluidic oscillator. The inertance plates have an air channel in them to carry the air to an air entrainment hole or port downstream of the power nozzle.

Thus, the object of the invention is to provide an improved fluidic spa nozzle. A further object of the invention is to provide an improved fluidic spa nozzle which incorporates a manually movable mode-change disc to control the sweeping of the jet back and forth in the spa.

Another object of the invention is to provide an improved fluidic spa nozzle which incorporates inertance loop plates which are interconnected by a pass-through. Another object of the invention is to provide a structure which enables the air to be introduced into the spa nozzle just downstream of the power nozzle and to maintain the inertance loop substantially free of air and thus maintain the inertance loop operable.

The inertance loop is comprised of a pair of plates secured to said top and bottom walls, respectively, each plate has a groove cut therein forming the inertance loop and having one end of said groove juxtaposed over an aperture in one of said control ports and the opposite end of said groove being juxtaposed over a passage passing between the top and bottom walls to interconnect with the end of a groove of opposing plates secured to the top and bottom walls. The spa tub nozzle includes a water ingestion port in the passage for purging air from said inertance loop.

BRIEF DESCRIPTION OF THE DRAWINGS

The above and other objects, advantages and features of the invention will become more apparent when considered with the following specification and attached drawings wherein.

DETAILED DESCRIPTION OF THE INVENTION

Figure 1:
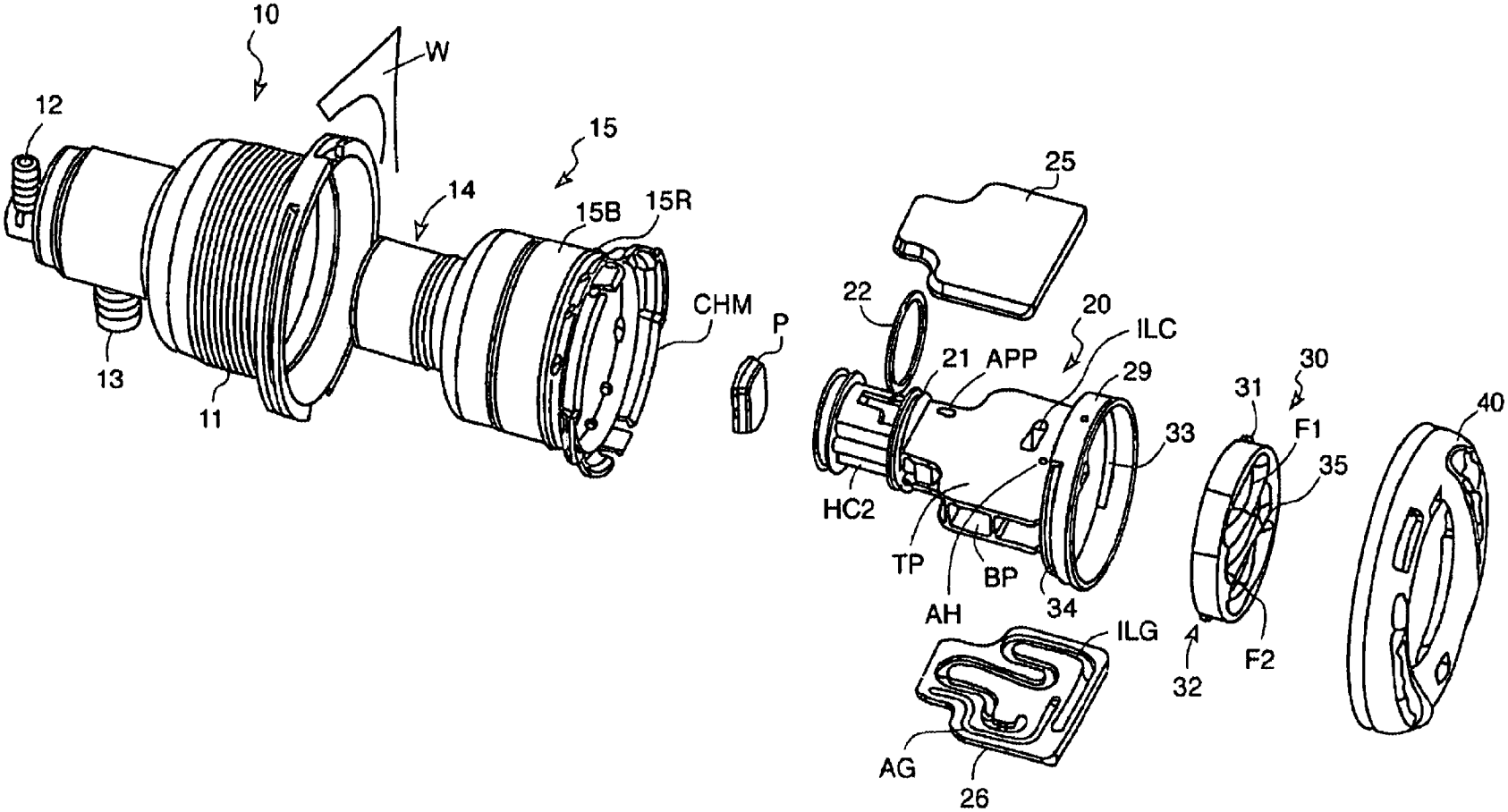
FIG. 1 is an exploded isometric view of a fluidic spa nozzle incorporating the invention.

Referring now to the exploded view of FIG. 1, the spa nozzle includes a main housing 10 which has an external threaded portion 11 for below the waterline securement or mounting by a gland nut (not shown) in the wall W of a spa, an air inlet barb 12 and a main water inlet barb 13. The air inlet 12 is connected to a valve (not shown) for ON/OFF control.

The upstream end 14 of subhousing 15 has a cutout 16 (FIG. 2A) that aligns with the flow inlet 13 to control water flow rate from full to about 30%. Subhousing 15 has a flared or bell-shaped section 15B and an annular rib 15R which engages the inner wall of main housing 10. The downstream end of the subhousing 15 has a hook element CHM which will be described later in connection with the securement thereto of the escutcheon 40.

Figure 2A:
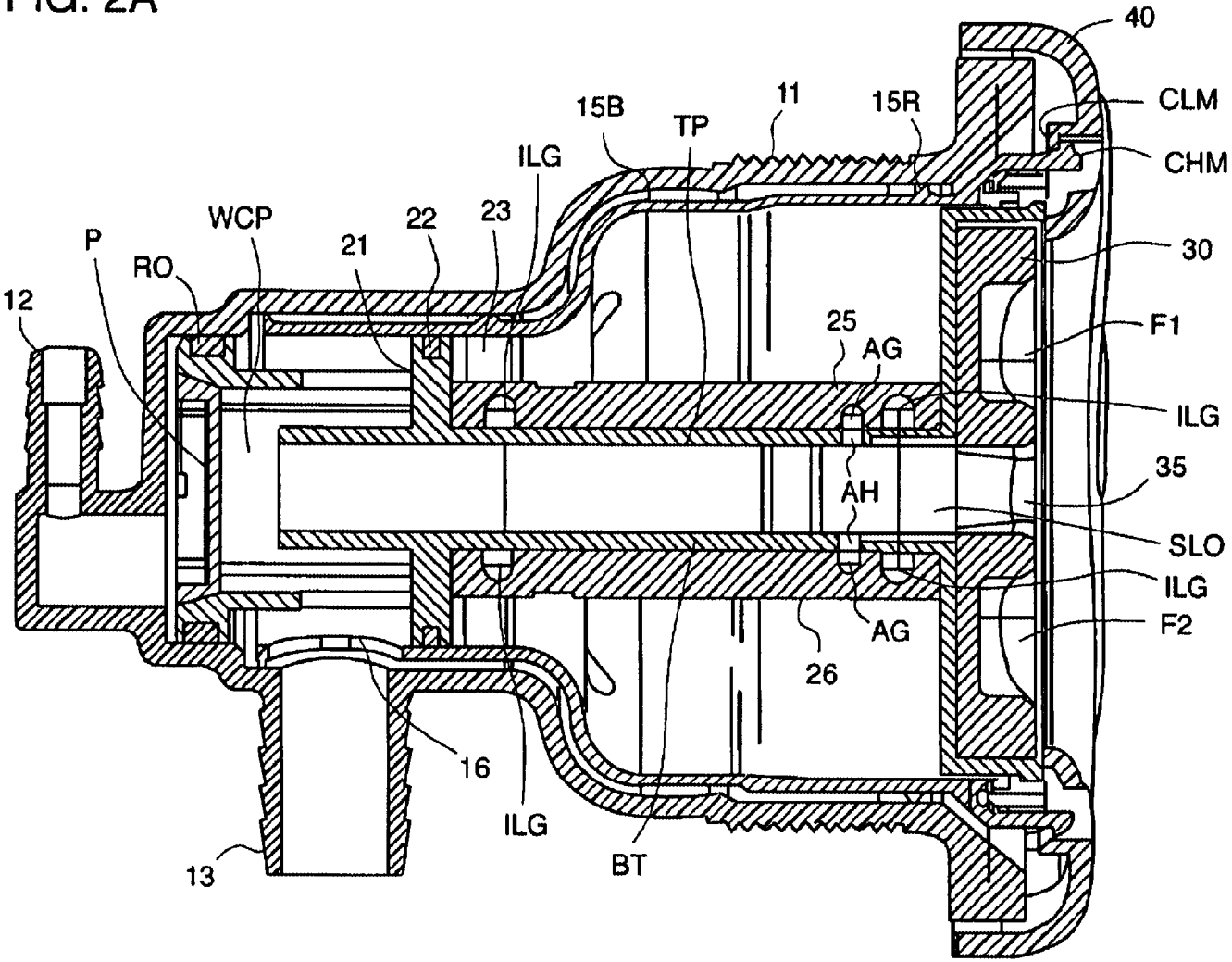
FIG. 2A is a sectional view of the assembled fluidic spa nozzle.
Figure 2B:
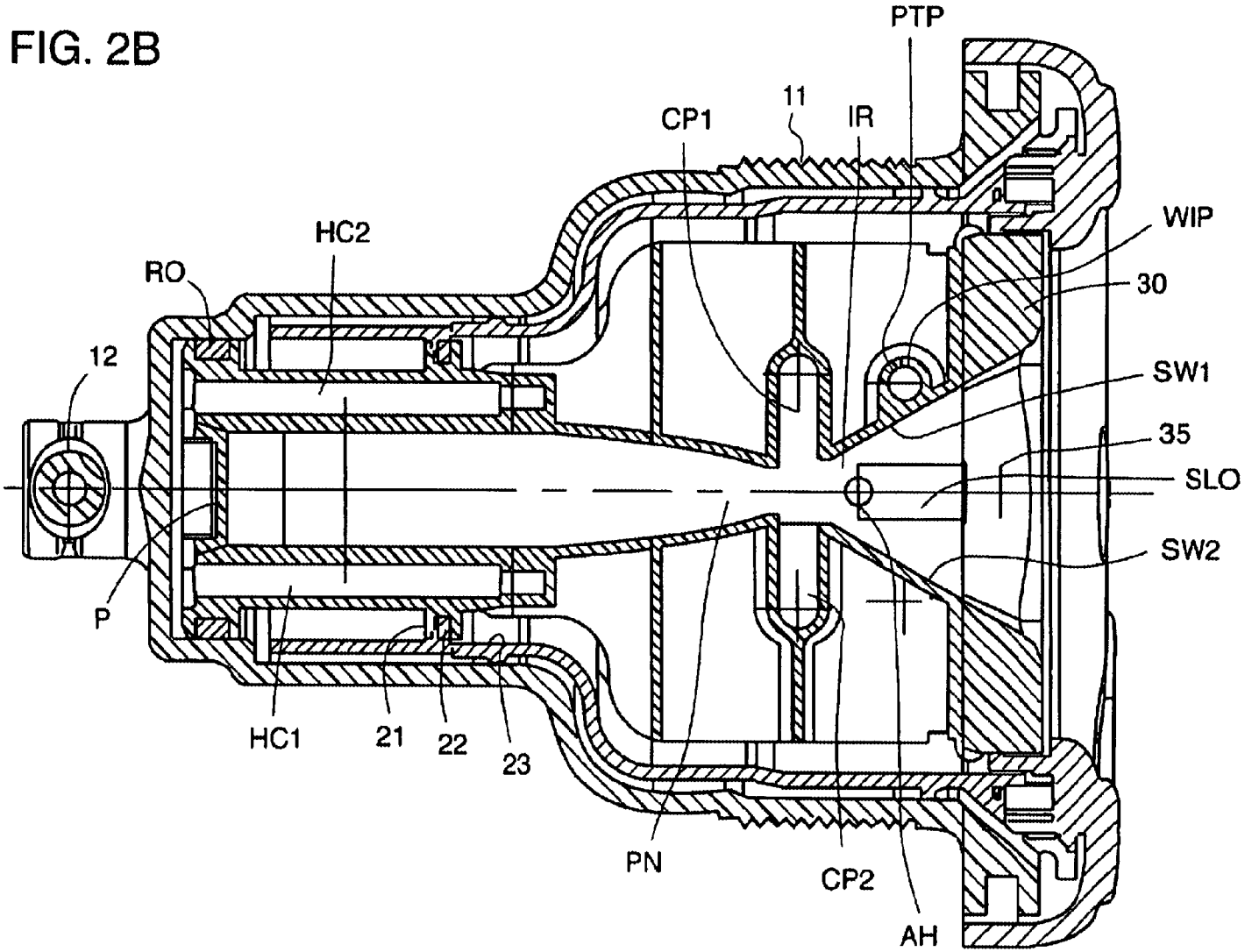
FIG. 2B is a sectional view taken on the plane of the device showing the fluidic silhouette.

The fluidic oscillator element 20 includes an annular dam member 21 that receives an O-ring member 22 which engages the inner wall 23 of the upstream end 14 of subhousing 15 (see FIGS. 2A and 2B). This forms a water chamber WCP for feeding water into the fluidic itself. The fluidic oscillator per se is shown in silhouette form in FIG. 2B and includes a plug P, a power nozzle PN for projecting a jet stream of water past a pair of control ports CP1, CP2 through an interaction region IR which has sidewalls SW1 and SW2 which diverge or flare outwardly toward ambient and top TP and bottom BT walls. Top and bottom inertance plates 25 and 26, respectively, are mounted on the top and bottom walls and have inertance loop forming grooves ILG (only one shown in FIG. 1) formed in the faces thereof. One inertance loop coupling aperture is shown in the view taken in FIG. 1 and designated as ILC for inertance loop connection passage to interconnect the control ports CP1 and CP2. A similar passage or opening is formed in the opposite control passage CP1, but in the opposite sidewall thereof. (See exploded view shown in FIG. 1.)

The opposing ends of the inertance grooves and the inertance loops themselves are juxtaposed over a pass-through passage PTP so that the inertance loop extends between the two control ports CP1, CP2 and controls the frequency of oscillation of the fluidic oscillator. Thus, the inertance loop between the two control ports CP1 and CP2 is comprised of inertance loop coupling passages ILC (one for each control port), two inertance loop grooves ILG (one in each of plates 25 and 26) which are connected by the passthrough passage PTP. The fluidic oscillator operates in a conventional fashion as follows: the water jet issues through power nozzle PN and passes across the control ports adjacent thereto and due to some perturbance, the jet will be closer to one or the other control port CP1 or CP2. This produces a pressure gradient across the jet at the control ports to switch the let to one side or the other and then the process repeats. As noted earlier, the length and size of the inertance loop plates attached to the control ports of the fluidic element set the oscillating frequency. The frequency oscillation or sweeping of the water jet into the spa tub per se can be changed by adjusting the length and size (area) of the inertance loops formed on the inertance loop plates.

An air passage or groove AG is formed in the top and bottom inertance plates for matching with other holes all in the body of the fluidic for air entrainment admission to air entrainment hole AH. In this embodiment the air entrainment hole AH is located downstream of the power nozzle PN. The fluidic interaction region IR has sidewalls SW1, SW2 that diverge downstream of the power nozzle PN to form a "V" shape. To obtain sufficient air entrainment, the air entrainment hole must be located close to the power nozzle where the jet is still focused. If the air entrainment hole AH is moved further downstream, the moving (sweeping) jet is not over the hole for a sufficient period of time to allow sufficient air to be drawn in.

When the air entrainment hole AH is positioned close to the power nozzle PN to optimize air entrainment, some quantity of air would be drawn into the inertance loop constituted by the groove AG in inertance plates 25, 26. Air is sufficiently less dense than water so its inclusion in the inertance loop would first raise the oscillating frequency, and then as more air contaminates the inertance loop, the oscillations would stop.

To solve this problem, a water ingestion port WIP is added to the inertance loop. In addition to slowing the frequency (desirable in this application), the key benefit of the water ingestion port WIP is to provide water to purge the air contamination from the inertance loop. Without the water ingestion port WIP, the air entrainment hole AH would need to be placed further downstream and less air would be entrained into the exiting water (undesirable).

Air entrainment may be enhanced by a slot structure SLO extending downstream of air entrainment port or hole AH, as is disclosed in Thurber et al application Ser. No. 09/899,547, filed Jul. 6, 2001, entitled SPA NOZZLES WITH AIR ENTRAINMENT, incorporated herein by reference.

Figure 3B:
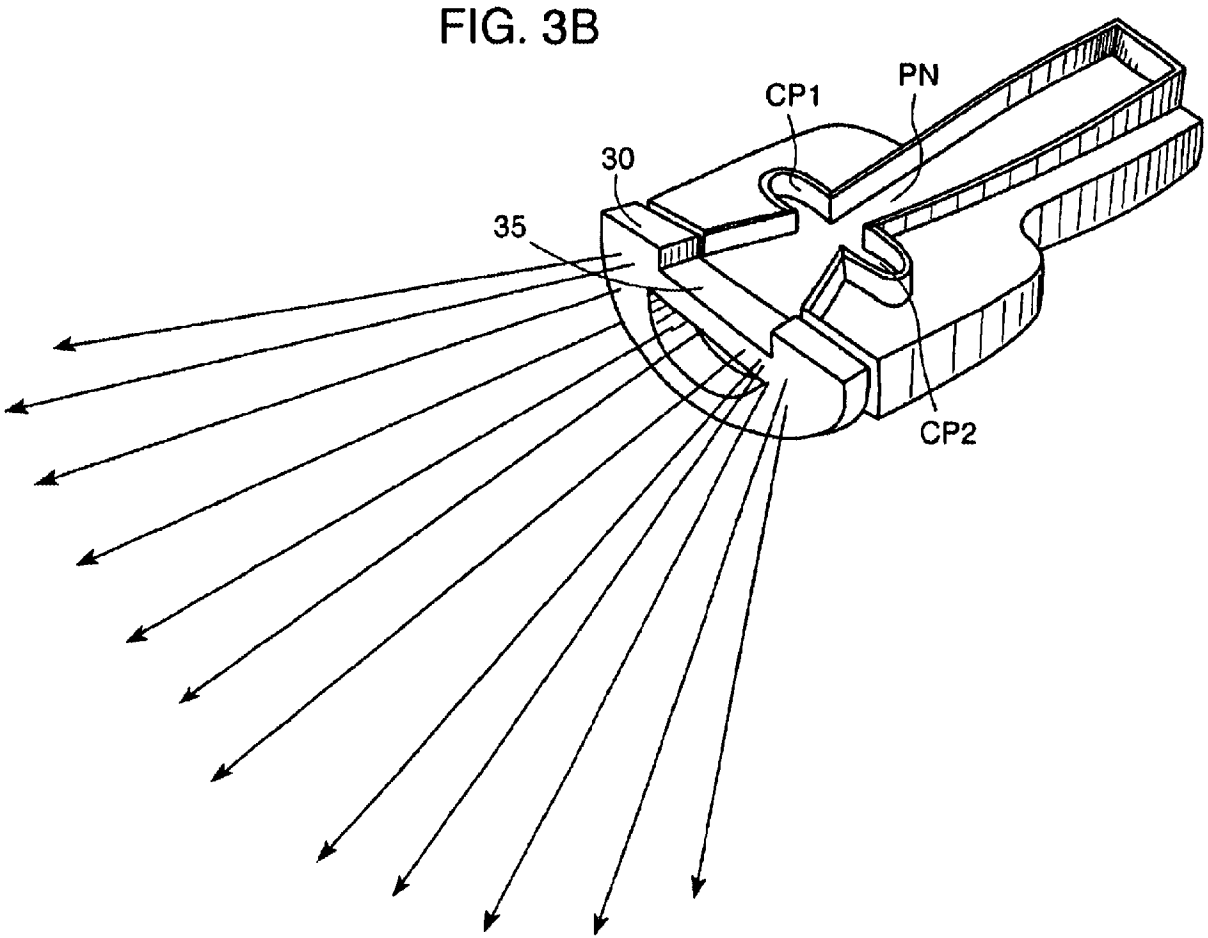
FIG. 3B is a schematic isometric view of the device showing the oscillating liquid jet.
Figure 3A:
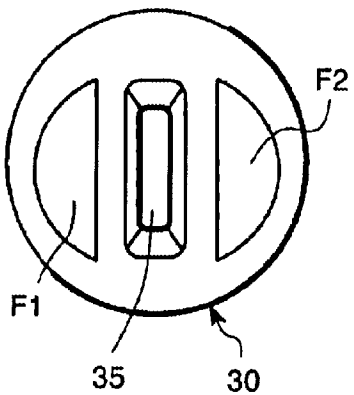
FIG. 3A is a front view of a schematic version of the device showing the mode disc.
Figure 3D:
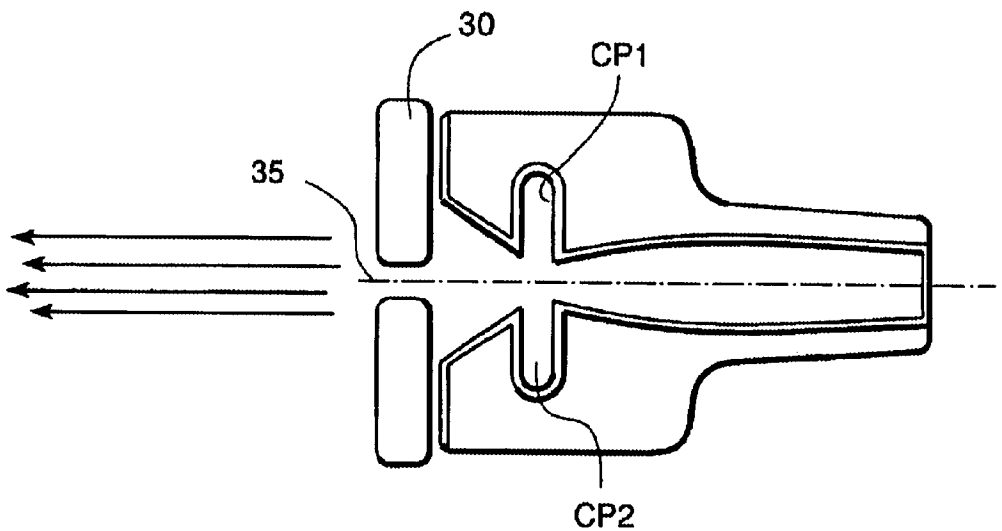
FIG. 3D is a further isometric schematic view showing the straight flow.
Figure 3C:
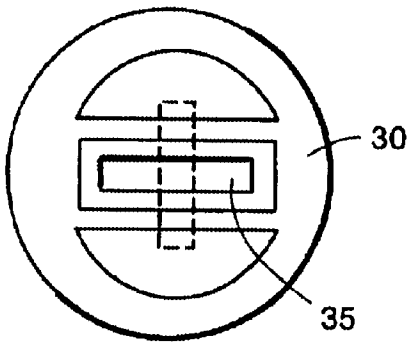
FIG. 3C is a schematic illustration showing the mode disc in a position to prevent sweeping.

Integrally molded with the fluidic is an annular ring 29 which receives a rotatable or movable mode change disc 30 which has tabs 31, 32 that are fitted into arcuate guide slots 33, 34. Mode change disc member 30 is also retained in position by a snap-on escutcheon member 40. Snap-on escutcheon member 40 has a cooperating latch member CLM which engages a cooperating hook member CHM on the downstream end of housing 15. Mode change disc 30 has an elongated slot 35. The important feature about mode-change disc 30 is the slot 35 and its orientation relative to the downstream end of the interaction region or chamber IR. As illustrated, the mode disc 30 is generally round and has a generally rectangular slot 35 therein. The slots 33, 34 and tabs 31, 32 allows the mode disc 30 to be rotated up to about 90° to change the outlet geometry and thus the sweep of fluid stream. At 0° rotation (FIGS. 3A–3B), the slot 35 is aligned with the diverging ends of the fluidic oscillator. As shown in FIG. 2B, the slot 35 is aligned with the width of the diverging end of sidewalls SW1 and SW2 of the interaction region IR, thus allowing the water jet to sweep. Thus at 0° rotation, the slot 34 provides a continuation of the exit geometry of the interaction region IR and allows the submerged jet to sweep or oscillate back and forth in the water of the spa tub. At 90° rotation, the slot 34 is perpendicular to the fluidic exit geometry. This results in the edges of the oscillating wave being backloaded, and the output is a straight focused jet. The rectangular slot 34 can be made larger with a generally round section to control the field of the straight jet in the jet mode. The disc 30 can be adjusted to angles from between 0° and 90° to achieve progressively narrower sweeping oscillations.

The mode control disc 30 has a pair of side slots or depressions F1, F2 to each side of the slot in the mode disc 30 to enable easy, ergonomic and firm grasping between the user's fingers.

In the straight jet mode, the jet may have a pulsating sensation, depending on the size of the opening chosen. This pulsation feels twice as quick as the oscillations in oscillating mode due to the jet passing through the center twice per oscillation.

In the straight jet mode, the water is concentrated in a smaller area than the oscillation mode. Therefore, the momentum flux and intensity, is greater. Control of the flow rates can be accomplished by rotating the sleeve valve formed in the subhousing and discussed briefly above.

Air can be routed through the central control valve on the spa nozzle to a manifold, and an air line (not shown) from this manifold is connected to each spa nozzle housing via air barb fitting 12. Air enters the rear of the housing and is separated from the water passages by the rear O-ring RO. The air passes through the two channels HC1 and HC2 on either side of the water chamber WCP. Air passages then turn 90° through aperture APP to the top and bottom inertance plates 25, 26 of the fluidic, and each of the inertance plates 25, 26 have an air channel AG in them to carry the air to the pass-through hole AH downstream of the power nozzle PN.

The fluidic oscillator can be set in any angular position. As illustrated in the drawings, the fluidic oscillator is constrained in its fore and aft position by being retained between the housing and the escutcheon. It is constrained from rotating by the friction of the rear O-ring.

While the invention has been described in relation to preferred embodiments of the invention, it will be appreciated that other embodiments, adaptations and modifications of the invention will be apparent to those skilled in the art.

What is claimed is:

1. A spa tub nozzle having a fluidic oscillator, a power nozzle in said fluidic oscillator adapted to be coupled to a source of water under pressure, said power nozzle projecting a water jet into an interaction region, said interaction region having top and bottom walls and diverging sidewalls and an inertance loop connecting said control ports to each other, respectively, the improvement comprising an air port coupleable to an air supply, said air port being formed in one of said top and bottom walls downstream of said power nozzle and upstream of the downstream end of said diverging side walls and about where the entrainment of air is at about the optimum and wherein said inertance loop includes a water ingestion port for purging air from said inertance loop.

2. The spa tub nozzle defined in claim 1 wherein said inertance loop is comprised of a pair of plates secured to said top and bottom walls, respectively, each said plates having an inertance loop groove formed therein and having one end of said groove juxtaposed over a respective aperture in one of said walls to a respective control port, a pass-through passage, the opposite ends of said grooves being juxtaposed over the ends of said pass-through passage passing between said top and bottom walls to interconnect with the ends of said grooves of opposing plates secured to said top and bottom walls.

3. The spa tub nozzle defined in claim 2 wherein said water ingestion port is in said pass-through passage.

4. A spa tub nozzle having a fluidic oscillator, a power nozzle in said fluidic oscillator coupled to a source of water under pressure, said power nozzle projecting a water jet into an interaction region, said interaction region having top and bottom walls and diverging sidewalls and an inertance loop connecting said control ports to each other, respectively, the improvement wherein said inertance loop is comprised of a pair of plates secured to said top and bottom walls, each said plates having a groove formed therein forming said inertance loop and having one end of said groove juxtaposed over an aperture in one of said walls to one of control ports, respectively, and the opposite end of said groove being juxtapositioned over a passage passing between said top and bottom walls to interconnect with the ends of said grooves in opposing plates secured to said bottom wall.

5. The spa tub nozzle defined in claim 4 including a slotted mode-change disc rotatably mounted just downstream of said diverging sidewalls and having a first position at 0°, a second position at 90°, at said 0° said jet is swept between the extremes defined by said diverging sidewalls and in said 90° position said jet is a straight jet of water concentrated in a smaller area than when in oscillation and has a greater momentum flux or intensity.

6. The spa nozzle defined in claim 4 including a nozzle housing mountable in a wall of said spa, and wherein said mode disc is retained in position in said housing by a snap-on escutcheon member, said snap-on escutcheon member having a cooperating latch member which engages a cooperating hook member on said nozzle housing.

7. The spa tub nozzle defined in claim 4 at least one of said top and bottom walls has an air port formed therein downstream of said power nozzle and upstream of the downstream end of said diverging sidewalls and about where the entrainment of air is at an optimum.

8. The spa tub nozzle defined in claim 7 wherein said air port is coupled to an air supply by a path that includes one or more air grooves in said plates.

9. The spa tub nozzle defined in claim 7 including a water ingestion port in said passage to purge air from said inertance loop.

10. A spa tub nozzle having a fluidic oscillator, a power nozzle in said fluidic oscillator coupled to a source of water under pressure, said power nozzle protecting a let of water into an interaction region said interaction region having top and bottom walls and diverging sidewalls, the improvement comprising: a mode-change member adjustably mounted downstream of said interaction chamber and having a slot therein, said slot being movable to be alienable with and transverse to said diverging sidewalls and wherein said fluidic oscillator has a pair of control ports contiguous to said power nozzle and an inertance loop interconnecting said control ports, said inertance loop including a pair of inertance loop plates, each of said inertance loop plates having an inertance loop groove formed therein, one end of said groove being coupled through an inertance loop coupling aperture to one of said control ports, respectively, the other end of said inertance loop groove being coupled through a pass-through passage to an end of the other inertance loop groove, respectively.

11. The spa tub nozzle defined in claim 10 wherein said mode-change member is rotatably mounted and has a first position at 0°, a second position at about 90°, at said 0° said jet is swept between the extremes defined by said sidewalls and in said 90° position said jet is a straight jet of water concentrated in a smaller area than when in oscillation and has a greater momentum flux or intensity.

12. The spa tub nozzle defined in claim 10 including a nozzle housing mountable in a wall of said spa, and wherein said mode disc is retained in position in said housing by a snap-on escutcheon member, said snap-on escutcheon member having a cooperating latch member which engages a cooperating hook member on said housing.

* * * * *